US007603753B2

(12) United States Patent
Baker

(10) Patent No.: US 7,603,753 B2
(45) Date of Patent: Oct. 20, 2009

(54) LOCKING ZIPPER PULL

(75) Inventor: Neil D. Baker, Amsterdam (NL)

(73) Assignee: NIKE, Inc., Beaverton, OR (US)

( * ) Notice: Subject to any disclaimer, the term of this patent is extended or adjusted under 35 U.S.C. 154(b) by 350 days.

(21) Appl. No.: 10/843,202

(22) Filed: May 11, 2004

(65) Prior Publication Data

US 2005/0251974 A1 Nov. 17, 2005

(51) Int. Cl.
*A44B 19/26* (2006.01)
*A44B 19/30* (2006.01)

(52) U.S. Cl. ..... 24/429; 24/415; 24/418

(58) Field of Classification Search ..... 24/415–432, 24/30.5 R

See application file for complete search history.

(56) References Cited

U.S. PATENT DOCUMENTS

| | | | | | |
|---|---|---|---|---|---|
| 1,651,544 | A | | 12/1927 | Prentice | 474/85 |
| 2,148,757 | A | * | 2/1939 | Kilkenny | 24/431 |
| 2,232,756 | A | * | 2/1941 | Marcus | 24/431 |
| 2,277,503 | A | * | 3/1942 | Pickens | 24/421 |
| 2,295,976 | A | * | 9/1942 | Suskowitz et al. | 24/426 |
| 2,303,750 | A | * | 12/1942 | Marinsky | 24/418 |
| 2,494,249 | A | * | 1/1950 | Krupp | 24/415 |
| 2,671,259 | A | | 3/1954 | Rinehart | |
| 4,604,775 | A | * | 8/1986 | Kusayama | 24/389 |
| 4,873,750 | A | * | 10/1989 | Tracy | 24/429 |
| 5,611,121 | A | * | 3/1997 | Akeno et al. | 24/423 |
| 6,286,999 | B1 | * | 9/2001 | Cappel et al. | 383/5 |
| D449,563 | S | | 10/2001 | Starck | D11/221 |
| 6,523,232 | B2 | | 2/2003 | Chen | 24/431 |
| 6,811,862 | B2 | * | 11/2004 | Yoshihara et al. | 24/415 |
| 7,404,240 | B2 | * | 7/2008 | Nedbal et al. | 24/415 |
| 2004/0020017 | A1 | * | 2/2004 | Nedbal et al. | 24/429 |
| 2005/0246872 | A1 | * | 11/2005 | Takazawa | 24/429 |

FOREIGN PATENT DOCUMENTS

| | | | | |
|---|---|---|---|---|
| DE | 37 17 288 | A1 * | 5/1987 | |
| DE | 37 17 288 | A1 * | 12/1998 | 24/415 |
| EP | 0 743 024 | A2 | 11/1996 | |
| EP | 1386556 | A1 | 2/2004 | |
| FR | 2248801 | | 5/1975 | |
| JP | 402164305 | A * | 6/1990 | |

OTHER PUBLICATIONS

Photograph—Samsonite/Phillipe Starck baggage pullers; One piece metal puller; Non locking.

* cited by examiner

*Primary Examiner*—Robert J Sandy
*Assistant Examiner*—Ruth C Rodriguez
(74) *Attorney, Agent, or Firm*—Banner & Witcoff, Ltd.

(57) ABSTRACT

A zipper pull for an invisible zipper includes a housing having a recess on an inner surface thereof. The recess is configured to receive at least a portion of a slider of a zipper. The pull remains stationary with respect to the slider when not in use. Leading and trailing ends of the housing have sloped surfaces that are configured to be grasped by fingers of a user.

22 Claims, 1 Drawing Sheet

LOCKING ZIPPER PULL

FIELD OF THE INVENTION

This invention relates generally to a locking zipper pull, and, in particular, to a locking zipper pull with improved functionality and convenience.

BACKGROUND OF THE INVENTION

Zipper pulls for use with so-called invisible zippers are well known. Typical zipper pulls for invisible zippers are thin planar plastic or metal members, which are secured to a slider by a hinge member. To operate the zipper, the user grasps the pull between the thumb and forefinger and pivots it outwardly away from the slider. The user can then operate the zipper to open or close the device to which the zipper is attached. A problem with such known zipper pulls is that when the zipper is not being operated, the pull is free to pivot and swing freely away from the slider. This may create distraction and discomfort to the user, such as when the zipper pull strikes the user's throat or face, and may cause unacceptable noise. Additionally, since the thin planar pull must be grasped between the thumb and forefinger, operability and flexibility for the user is limited.

It is an object of the present invention to provide a locking zipper pull that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide a zipper pull with a reduced profile, improved operability, and one that can be grasped from multiple positions.

In accordance with a first aspect, a zipper pull for an invisible zipper includes a housing having a recess on an inner surface thereof. The recess is configured to receive at least a portion of a slider of a zipper. The pull remains stationary with respect to the slider when not in use. Leading and trailing ends of the housing have sloped surfaces that are configured to be grasped by fingers of a user.

In accordance with another aspect, a zipper pull includes a housing having a first portion and a second portion. The first portion has a first hardness and includes a recess on an inner surface thereof configured to receive at least a portion of a slider for a zipper. The second portion has a second hardness, with the second hardness being lower than the first hardness.

In accordance with a further aspect, a zipper pull for an invisible zipper includes a substantially T-shaped housing. A leg of the T-shape forms a leading end when the pull is used to open a zipper. A cross member of the T-shape forms the leading end when the pull is used to close a zipper. An end of the leg has a sloped surface, and an end of the cross member has a sloped surface. A recess is formed on a lower surface of the housing and is configured to receive at least a portion of a slider of a zipper. A pair of recesses is formed on opposed sides of the leg, with the recesses configured to be grasped by fingers of a user.

Substantial advantage is achieved by providing a locking zipper pull in accordance with preferred embodiments of the present invention. In particular, preferred embodiments of the zipper pull advantageously allow a user to grasp the pull from many different angles, improving ease of use. Additionally, the pull provides a low profile and remains stationary with respect to the slider when not in use, so as to not interfere with the user.

These and additional features and advantages of the invention disclosed here will be further understood from the following detailed disclosure of certain preferred embodiments.

Figure 1:
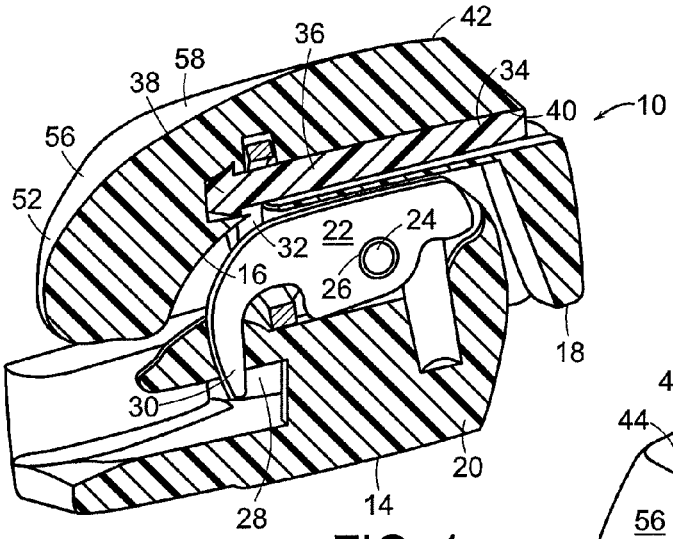
FIG. 1 is a section view of the locking zipper assembly having a slider and a zipper pull in accordance with a preferred embodiment of the present invention.

The figures referred to above are not drawn necessarily to scale and should be understood to provide a representation of the invention, illustrative of the principles involved. Some features of the locking zipper pull depicted in the drawings have been enlarged or distorted relative to others to facilitate explanation and understanding. The same reference numbers are used in the drawings for similar or identical components and features shown in various alternative embodiments. Locking zipper pulls as disclosed herein would have configurations and components determined, in part, by the intended application and environment in which they are used.

DETAILED DESCRIPTION OF CERTAIN PREFERRED EMBODIMENTS

The present invention may be embodied in various forms. A locking zipper assembly 10 is illustrated in FIG. 1 for use on an invisible zipper (not shown). Certain directional terms used herein refer to directions with respect to zipper assembly 10 and its associated zipper. Thus, the terms outward, or outer, as used herein, refer to a surface facing away from, or a direction extending away from a zipper along which zipper assembly 10 travels. Consequently, outward and outer, as seen in FIG. 1, refer to a direction extending toward the top of the page. The terms inward or inner refer to a surface facing toward, or a direction extending toward the zipper along which zipper assembly 10 travels. Thus, inward and inner, as seen in FIG. 1, refer to a direction extending toward the bottom of the page Zipper assembly 10 includes a zipper pull 12 and a slider 14. Zipper pull 12 and slider 14 cooperate to allow a user to open and close a zipper (not shown), and preferably an invisible zipper. A primary recess 16 is formed in a lower surface 18 of zipper pull 12. Primary recess 16 is configured to receive at least a portion of slider 14, allowing zipper pull 12 to have a relatively low profile, while still providing an adequate surface for a user to grasp zipper pull 12 from multiple positions.

Slider 14 includes a base 20 and a pivot member 22 that is pivotally secured to base 20 by a pin 24 that extends through an aperture 26 formed in pivot member 22. Base 20 includes two apertures 28 (only one of which is visible in this section view), through which the separate halves of the zipper are guided. Pivot member 22 includes a locking pin or claw 30 that engages the teeth of the zipper to lock zipper assembly 10 in place with respect to the zipper.

A loop member 32 extends around both of a base of locking claw 30 and a retaining pin 34, which is housed in zipper pull 12, and serves to connect zipper pull 12 to locking claw 30. Retaining pin 34 has a shaft 36 and a barbed end 38, and is received in a secondary recess 40 formed in zipper pull 12. Secondary recess 40 extends inwardly from an exterior surface of zipper pull 12 and is in communication with primary recess 16. Barbed end 38 acts to secured retaining pin 34 within secondary recess 40 of zipper pull 12. In a preferred embodiment, barbed end 38 has a trapezoidal cross-section.

To disengage locking claw 30 from the zipper, zipper pull 12 is grasped by the user and pulled slightly outwardly. As zipper pull moves outwardly, loop 32 is pushed outwardly by retaining pin 34 and pulls locking claw 30 outwardly, releasing locking claw 30 from engagement with the zipper. To engage locking claw 30, zipper pull 12 is simply pushed slightly inwardly. Advantageously, zipper pull 12 remains substantially stationary with respect to slider 14 when the zipper is not in use. It is to be appreciated that there may be a slight movement of zipper pull 12 with respect to slider 14 when the zipper is not in use due to manufacturing tolerances and slight play between the components of zipper assembly 10.

It is to be appreciated that the slider 14 illustrated in FIG. 1 is merely one example of a slider with which zipper pull 12 can cooperate to unlock and operate the zipper. Other suitable sliders with which zipper pull 12 can work will become readily apparent to those skilled in the art, given the benefit of this disclosure.

Figure 2:
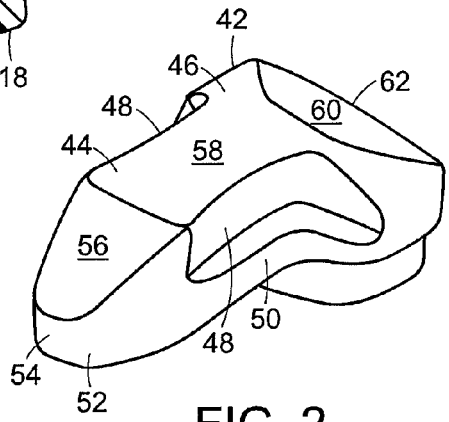
FIG. 2 is a perspective view of the locking zipper pull of FIG. 1.
Figure 3:
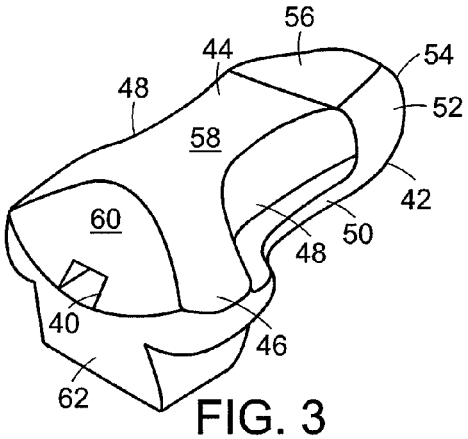
FIG. 3 is a top plan view of the locking zipper pull of FIG. 1.
Figure 4:
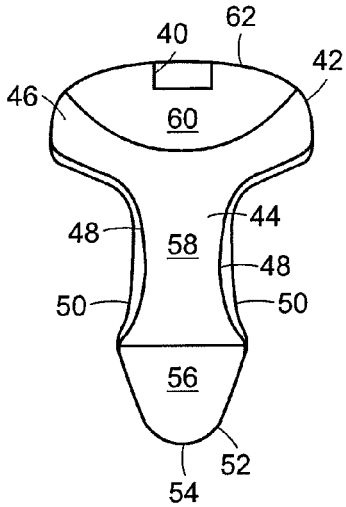
FIG. 4 is another perspective view of the locking zipper pull of FIG. 1.

A preferred embodiment of zipper pull 12 is illustrated in FIGS. 2-4 and is formed of a housing 42. Housing 42 is substantially T-shaped with a leg 44 joined to a cross member 46. A pair of recesses 48 are formed in housing 42, with each recess 48 extending along a portion of the length of sides 50 of leg 44 to its intersection with cross member 46 and then along a portion of the length of cross member 46. Recesses 48 provide convenient surfaces with which a user can grasp and operate zipper pull 12 from opposed sides of leg 44.

The sides and top of end 52 of leg 44 are preferably tapered. Specifically, leg 44 is tapered from sides 50 toward an end surface 54 of leg 44. A sloped surface 56 is formed at the intersection of end surface 54 and an outer surface 58 of leg 44. Similarly, a sloped surface 60 is formed at the intersection of a side surface 62 of cross member 46 and outer surface 48. Side surface 62, as seen here, is that side of cross member 46 that is perpendicular to the axis of leg 44, and is perpendicular to the path of travel of zipper assembly 10. Sloped surfaces 56, 60 provide additional convenient surfaces with which a user can grasp and operate zipper pull 12. Thus, zipper pull 12 can be grasped and operated from many different directions.

Figure 5:
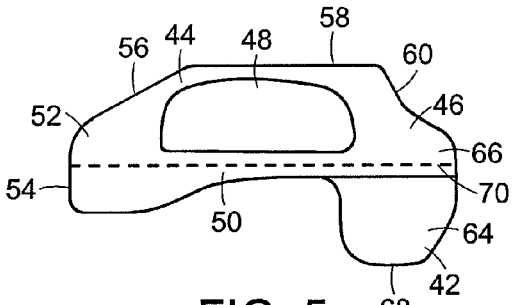
FIG. 5 is a side elevation view of an alternative embodiment of the locking zipper pull of FIG. 1.

Another embodiment of zipper pull 10 is illustrated in FIG. 5. In this embodiment, zipper pull 10 is formed of a first or inner portion 64 and a second or outer portion 66. An inner surface 68 of inner portion 64 is configured to be in contact with the teeth of the zipper as zipper assembly 10 moves. Outer portion 66 is configured to be grasped by the user to operate the zipper. Inner portion 64 and outer 66 are formed with different hardness levels. Specifically, outer portion 66 is formed with a material having a lower hardness level, providing a softer material that can easily be gripped by a user to facilitate operating zipper assembly 10. Inner portion 64, on the other hand, is formed of a material having a higher hardness level, providing a harder material that will slide easily along the zipper. In a preferred embodiment, inner portion 64 has a hardness level of between approximately 70 sh A and 90 sh A, and more specifically about 80 sh A. In a preferred embodiment, outer portion 66 has a hardness level of between approximately 40 sh A and 60 sh A, and more specifically about 50 sh A.

As illustrated here, inner portion 64 and outer portion 66 are shown separated by a dashed line 70. It is to be appreciated that inner portion 64 and outer portion 66 may be of unitary, that is, one-piece construction. For example, inner portion 64 and outer portion 66 could be co-molded. In other embodiments, inner portion 64 and outer portion 66 could be separately formed and secured together such as with an adhesive.

In a preferred embodiment, inner portion 64 and outer portion 66 are formed of silicone. It is to be appreciated that inner portion 64 and outer portion 66 may be formed of the same, or different, materials. Other suitable materials for either or both of inner portion 64 and outer portion 66 include Silicon 50 sh A and polyurethane. Other suitable materials for inner portion 64 and outer portion 66 will become readily apparent to those skilled in the art, given the benefit of this disclosure.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A zipper pull for an invisible zipper comprising, in combination:

a housing having a leg and a cross member at one end of the leg and a recess on a lower surface thereof configured to receive at least a portion of a slider of a zipper, the housing configured to remain substantially stationary with respect to the slider when not in use, the leg forming a leading end when the pull is used to open a zipper, the cross member forming the leading end when the pull is used to close a zipper, the leg and cross member having sloped surfaces configured to be grasped by fingers of a user;

a pair of step-shaped recesses, each step-shaped recess extending along one side of the leg and along a portion of the member;

a secondary recess extending inwardly from an outer surface of the housing parallel to a longitudinal axis of the leg and in communication with the recess on the lower surface of the housing; and a retaining pin received in the secondary recess to retain the housing on the zipper pull.

2. The zipper pull of claim 1, wherein each of the sloped surfaces extends from the outer surface of the housing to a respective end of the housing.

3. The zipper pull of claim 1, wherein the housing includes a first portion having a first hardness and configured to contact a slider of a zipper, and a second portion having a second hardness and configured to be grasped by a user, the second hardness being lower than the first hardness.

4. The zipper pull of claim 3, wherein the first and second portions are made of silicone.

5. The zipper pull of claim 3, wherein the first and second portions are of unitary construction.

6. The zipper pull of claim 3, wherein the first hardness is between approximately 70 sh A and 90 sh A.

7. The zipper pull of claim 3, wherein the second hardness is between approximately 40 sh A and 60 sh A.

8. The zipper pull of claim 1, wherein one of the sloped surfaces extends from the outer surface of the leg to an end of the leg.

9. The zipper pull of claim 1, wherein one of the sloped surfaces extends from the outer surface of the cross member to an end of the cross member.

10. The zipper pull of claim 1, wherein the leg is tapered from sides of the leg toward an end of the leg.

11. A zipper pull comprising, in combination:

a substantially T-shaped housing having a first portion and a second portion, the first portion having a first hardness and including a recess on an inner surface thereof configured to receive at least a portion of a slider for a zipper, the second portion having a second hardness, the second hardness being lower than the first hardness;

a pair of step-shaped recesses, each step-shaped recess extending along one side of a leg of the T-shaped housing and along a portion of a cross member of the T-shaped housing;

a secondary recess extending inwardly from an outer surface of the housing parallel to a longitudinal axis of the leg and in communication with the recess on the inner surface of the housing; and a retaining pin received in the secondary recess to retain the housing on the zipper pull.

12. The zipper pull of claim 11, wherein the housing is formed of silicone.

13. The zipper pull of claim 11, wherein the first hardness is between approximately 70 sh A and 90 sh A.

14. The zipper pull of claim 11, wherein the second hardness is between approximately 40 sh A and 60 sh A.

15. The zipper pull of claim 11, wherein the housing is configured to remain stationary with respect to the slider when not in use.

16. A zipper pull for an invisible zipper comprising, in combination:

a substantially T-shaped housing, a leg of the T-shaped housing forming a leading end when the pull is used to operate a zipper in a first direction, a cross member of the T-shaped housing forming the leading end when the pull is used to operate the zipper in an opposed second direction, an end of the leg having a sloped surface and an end of the cross member having a sloped surface;

a recess formed on a lower surface of the housing and configured to receive at least a portion of a slider of a zipper;

a pair of step-shaped recesses on opposed sides of the leg, each step-shaped recess extending along one side of the leg and along a portion of the cross member and configured to be grasped by fingers of a user;

a secondary recess extending inwardly from an outer surface of the housing parallel to a longitudinal axis of the leg and in communication with the recess on the inner surface of the housing; and a retaining pin received in the secondary recess to retain the housing on the zipper pull.

17. The zipper pull of claim 16, wherein the housing is configured to remain substantially stationary with respect to a slider when not in use.

18. The zipper pull of claim 16, wherein the housing includes a first portion having a first hardness and configured to contact a slider of a zipper, and a second portion having a second hardness and configured to be grasped by a user, the second hardness being lower than the first hardness.

19. The zipper pull of claim 18, wherein the first and second portions are made of silicone.

20. The zipper pull of claim 19, wherein the first and second portions are of unitary construction.

21. The zipper pull of claim 18, wherein the first hardness is between approximately 70 sh A and 90 sh A.

22. The zipper pull of claim 18, wherein the second hardness is between approximately 40 sh A and 60 sh A.

* * * * *

UNITED STATES PATENT AND TRADEMARK OFFICE

CERTIFICATE OF CORRECTION

PATENT NO. : 7,603,753 B2
APPLICATION NO. : 10/843202
DATED : October 20, 2009
INVENTOR(S) : Neil D. Baker It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 392 days.

Signed and Sealed this

Fifth Day of October, 2010

David J. Kappos

David J. Kappos
*Director of the United States Patent and Trademark Office*